US007209685B2

(12) United States Patent
Oyama et al.

(10) Patent No.: US 7,209,685 B2
(45) Date of Patent: Apr. 24, 2007

(54) DEVELOPING DEVICE, IMAGE FORMING APPARATUS AND PROCESS CARTRIDGE INCLUDING REPLENISHMENT OPENINGS

(75) Inventors: Hajime Oyama, Chiba (JP); Katsuhiro Aoki, Kanagawa (JP); Hiromitsu Takagaki, Kanagawa (JP); Hiroshi Ikeguchi, Saitama (JP); Yasuo Miyoshi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/175,282

(22) Filed: Jul. 7, 2005

(65) Prior Publication Data

US 2006/0008297 A1 Jan. 12, 2006

(30) Foreign Application Priority Data

Jul. 12, 2004 (JP) ..... 2004-204722

(51) Int. Cl.
*G03G 15/08* (2006.01)

(52) U.S. Cl. ..... 399/254; 399/260

(58) Field of Classification Search ..... None
See application file for complete search history.

(56) References Cited

U.S. PATENT DOCUMENTS

| | | | |
|---|---|---|---|
| 4,821,075 | A | 4/1989 | Saito et al. |
| 5,339,141 | A | 8/1994 | Suzuki et al. |
| 5,424,814 | A | 6/1995 | Suzuki et al. |
| 5,493,382 | A | 2/1996 | Takagaki et al. |
| 5,502,552 | A | 3/1996 | Iwata et al. |
| 5,565,973 | A | 10/1996 | Fujishiro et al. |
| 5,604,575 | A | 2/1997 | Takagaki et al. |
| 5,737,680 | A | 4/1998 | Takagaki et al. |
| 6,163,669 | A | 12/2000 | Aoki et al. |
| 6,295,437 | B1 | 9/2001 | Hodoshima et al. |
| 6,505,014 | B2 | 1/2003 | Aoki et al. |
| 6,526,248 | B1 | 2/2003 | Aoki et al. |
| 6,608,984 | B1 | 8/2003 | Matsumoto et al. |
| 6,658,227 | B2 | 12/2003 | Oyama et al. |

(Continued)

FOREIGN PATENT DOCUMENTS

JP 08069180 A * 3/1996

(Continued)

OTHER PUBLICATIONS

U.S. Appl. No. 11/175,282, filed Jul. 7, 2005, Oyama et al.
U.S. Appl. No. 11/395,186, filed Apr. 3, 2006, Miyoshi.

*Primary Examiner*—Quana Grainger
(74) *Attorney, Agent, or Firm*—Oblon, Spivak, McClelland, Maier & Neustadt, P.C.

(57) ABSTRACT

A developing device for developing a latent image formed on an image carrier of the present invention is generally made up of a developing section and a developer storing section. The developing section includes a developer carrier for conveying a one-component type developer deposited thereon, a feeding member for feeding the developer to the developer carrier, and a conveying member for conveying the developer toward the feeding member while agitating it. The developer storing section replenishes a developer stored therein to the developing section in a direction including at least a horizontal direction component. The developing section and developer storing section are formed with a plurality of openings in the lengthwise direction such that the replenishment of developer from the developer storing section to the developing section and the return of the developer from the latter to the former are executed via the openings.

17 Claims, 7 Drawing Sheets

U.S. PATENT DOCUMENTS

| | | | | |
|---|---|---|---|---|
| 6,721,516 | B2 | 4/2004 | Aoki et al. | |
| 6,901,233 | B2 | 5/2005 | Aoki et al. | |
| 2004/0008999 | A1 * | 1/2004 | Iino | 399/29 |
| 2004/0265015 | A1 | 12/2004 | Koike et al. | |

FOREIGN PATENT DOCUMENTS

| | | | |
|---|---|---|---|
| JP | 2002-333764 | | 11/2002 |
| JP | 2005300942 | A * | 10/2005 |

* cited by examiner

DEVELOPING DEVICE, IMAGE FORMING APPARATUS AND PROCESS CARTRIDGE INCLUDING REPLENISHMENT OPENINGS

BACKGROUND OF THE INVENTION

1. Field of the Invention

The present invention relates to a developing device for use in a copier, facsimile apparatus, printer or similar image forming apparatus, an image forming apparatus using the same and a process cartridge.

2. Description of the Background Art

A developing device of the type using only toner grains, i.e., a one-component type of toner not containing carrier grains is extensively used. This type of developing device is configured to charge the toner grains in a casing by agitating them and then convey the charged toner grains to a toner carrier. The toner grains thus deposited on the toner carrier are regulated in amount by a metering member and then brought to a developing zone where the toner carrier and an image carrier face each other at the shortest distance. At the developing zone, the toner grains are transferred from the toner carrier to the image carrier to thereby develop a latent image formed on the image carrier.

While the toner grains deposited on the toner carrier should ideally be entirely charged to preselected polarity, some of such toner grains are, in practice, not fully charged. Should the toner grains with short charge be conveyed via the metering member, they would fly away from the toner carrier and would thereby smear the inside of the image forming apparatus as well as paper sheets or similar recording medium.

Further, toner and members that strongly rub against the toner, e.g., the toner carrier, a toner feeding member and the metering member vary with the elapse of time, and so does the toner electrifying ability. As a result, it soon becomes difficult for such members to electrify each other. In addition, it is likely that additives present on the surfaces of the individual toner grains are separated from or buried in the surfaces of the toner grains and fail to exhibit a fluidity enhancing function and an electrification control function expected thereof. Consequently, the ratio of toner grains with short charge to the entire toner grains is apt to increase, and toner grains of opposite polarity and short charge are also apt to increase. If such toner grains are conveyed to the developing zone by the toner carrier, then they smear the background of an image and thereby lower the quality of the image.

In light of the above, various devices have heretofore been proposed to control stress to act on toner grains or to discharge a developer from a developing device before the developer is critically deteriorated. Japanese Patent Laid-Open Publication No. 2002-333764, for example, proposes to obviate, e.g., the blow-off or the blocking of toner grains ascribable to the excessive replenishment from a toner replenishing or storing section to a developing section by returning excessive part of the toner grains to the toner replenishing section. At this instant, part of toner grains with short charge is also returned to the toner replenishing section because of the replacement of toner grains, so that image quality is maintained at a certain acceptable level.

However, the system proposed by the above document has some problems left unsolved. For example, toner grains replenished from the toner replenishing section are soon returned to the replenishing section or not smoothly returned to the replenishing section with the result that excess toner grains increase dynamic torque to an unusual level.

SUMMARY OF THE INVENTION

It is an object of the present invention to provide a developing device capable of smoothly discharging toner grains from a developing section, an image forming apparatus using the same and a process cartridge.

A developing device for developing a latent image formed on an image carrier of the present invention is generally made up of a developing section and a developer storing section. The developing section includes a developer carrier for conveying a one-component type developer deposited thereon, a feeding member for feeding the developer to the developer carrier, and a developer conveying member for conveying the developer toward the feeding member while agitating it. The developer storing section replenishes a developer stored therein to the developing section in a direction including at least a horizontal direction component. The developing section and developer storing section are formed with a plurality of openings in the lengthwise direction such that the replenishment of developer from the developer storing section to the developing section and the return of the developer from the latter to the former are executed via the openings.

DESCRIPTION OF THE PREFERRED EMBODIMENTS

Figure 1:
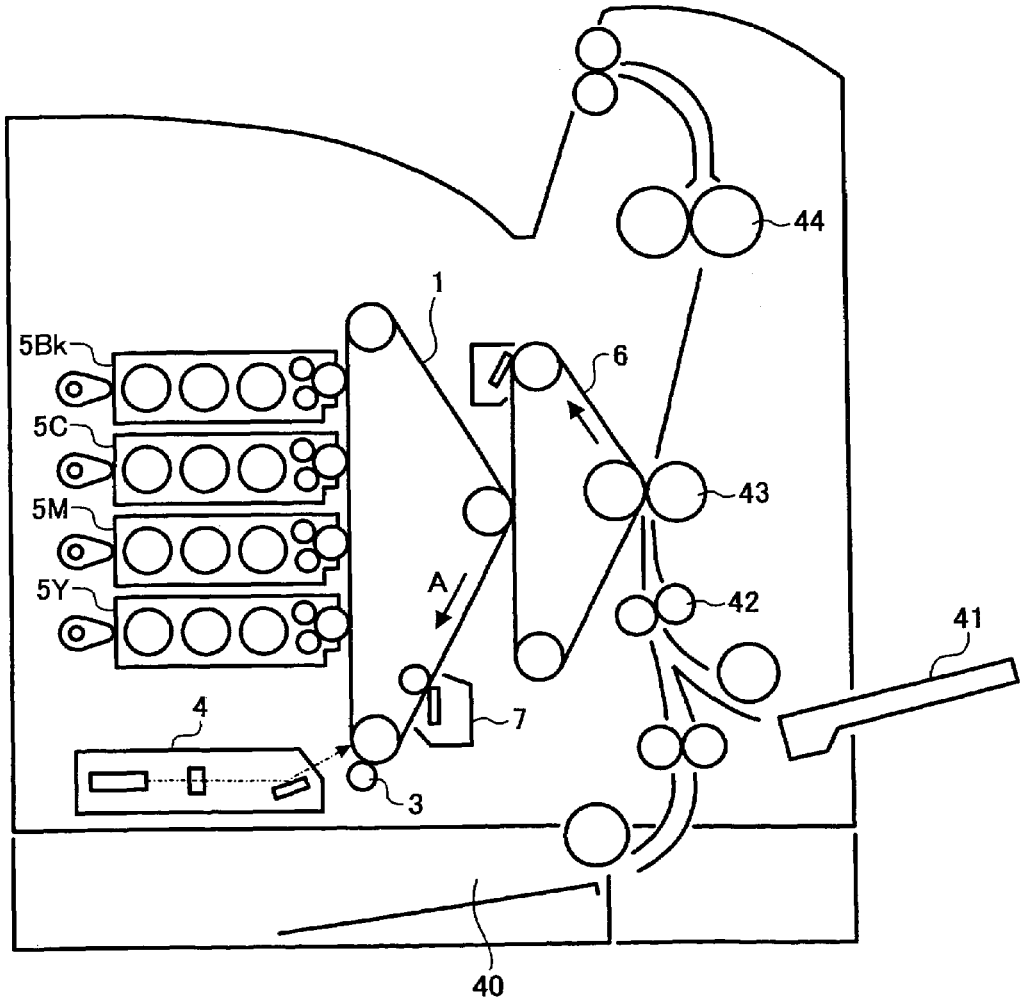
FIG. 1 is a front view showing an image forming apparatus embodying the present invention and implemented as a printer by way of example.

Referring to FIG. 1 of the drawings, an image forming apparatus embodying the present invention is shown in a front view and implemented as a printer by way of example. As shown, the printer includes a photoconductive belt or image carrier 1 passed over a plurality of support rollers and caused to turn clockwise, as indicated by an arrow A in FIG. 1. Arranged around the photoconductive belt 1 are a charger 3, an optical writing unit 4, and four developing units or devices 5Bk (black), 5C (cyan), 5M (magenta) and 5Y (yellow). An intermediate image transfer belt or intermediate image transfer body 6 and a belt cleaner 7 are also located in the vicinity of the photoconductive belt 1. An OPC (Organic PhotoConductor) layer, not shown, is formed on the surface of the intermediate image transfer belt. Let the photoconductive belt 1 and intermediate image transfer belt 6 be simply referred to as belts 1 and 6, respectively, hereinafter.

In operation, the charger 3 is applied with a high-tension voltage for uniformly charging the surface of the belt 1. An image signal processor, not shown, converts color image data, e.g., a color image signal received from a computer to an optical writing signal and sends the optical writing signals to the optical writing unit 4. The optical writing unit 4 controls a laser or light source in accordance with the optical writing signal, thereby scanning the belt 1 with a laser beam. As a result, a latent image representative of a Bk (black), a C (cyan), an M (magenta) or a Y (yellow) image is formed on the belt 1. The developing units 5Bk through 5Y, each storing fresh toner or developer of a particular color and charged to opposite polarity to the latent image, each develop one of the above latent images Bk, C, M and Y corresponding in color thereto to thereby form a toner image of a particular color.

At a position where the belts 1 and 6 contact each other, the toner image is transferred from the belt 1 to the belt 6 by a charge opposite in polarity to the toner image applied to the belt 6. Such steps of forming a toner image and transferring it from the belt 1 to the belt 6 are repeated four consecutive times for completing a composite four- or full-color image on the belt 6. The color image thus formed on the belt 6 is transferred to a paper sheet or similar recording medium selectively fed from a sheet cassette 40 or a manual feed tray 41 via a roller pair 42 by a transfer roller 43. The paper sheet, carrying the color image thereon, is conveyed to a fixing unit represented by a fixing roller pair 44 and has the color image fixed thereby.

Figure 2:
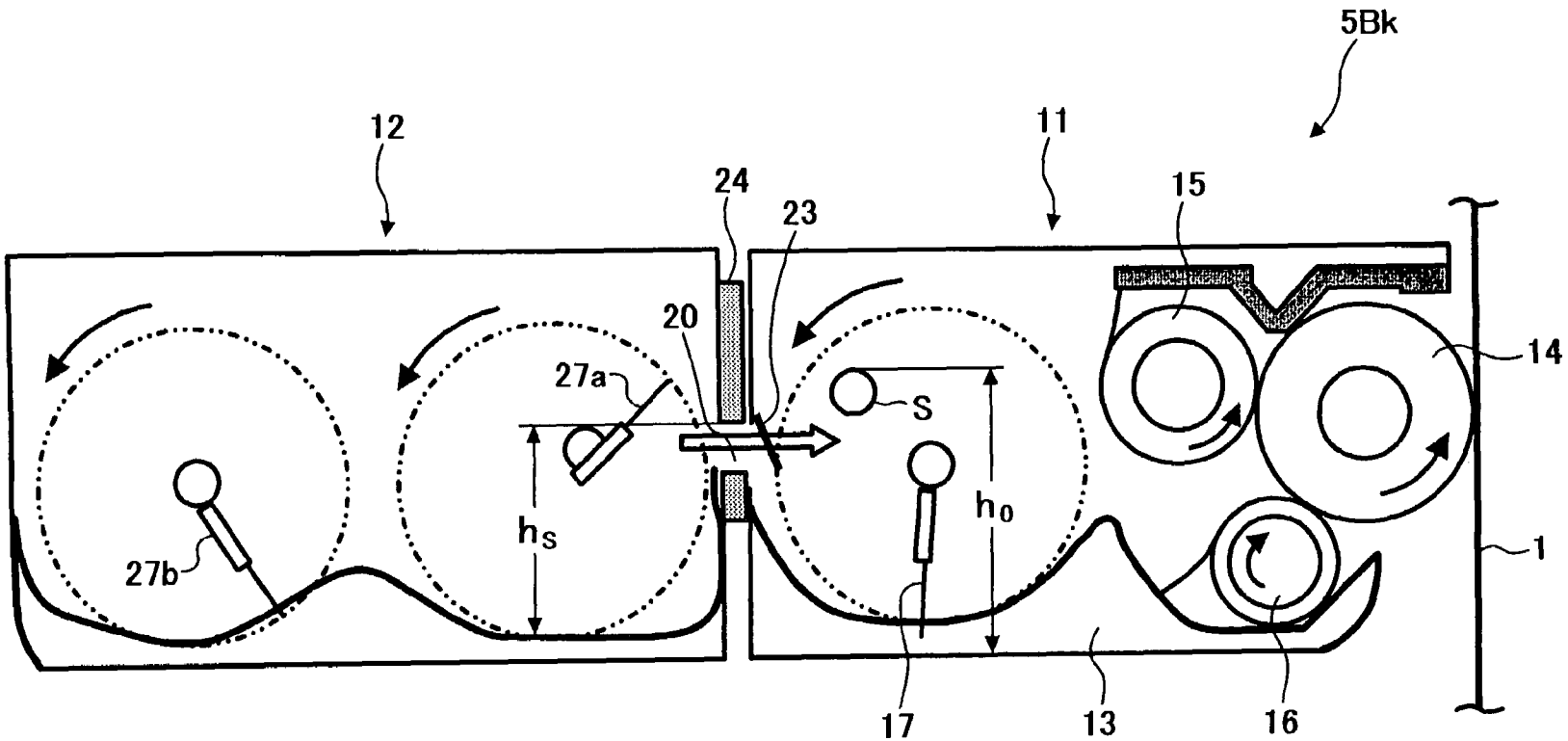
FIG. 2 is a section showing a toner or developer replenishing opening included in the illustrative embodiment.

Reference will be made to FIG. 2 for describing the developing units 5Bk through 5Y unique to the illustrative embodiment. Because the developing units 6Bk through 5Y are identical in configuration with each other except for the color of toner or developer to use, let the following description concentrate on the developing unit 5Bk by way of example. The developing unit 5Bk of the illustrative embodiment uses a one-component type developer, i.e., toner.

As shown in FIG. 2, the developing unit 5Bk is generally made up of a developing section 11 and a toner cartridge or developer storing section 12. The developing section 11 is provided with durability high enough to withstand repeated use while the toner cartridge 12 is bodily replaced when run out of toner. The developing section 11 includes a casing 13 formed with an opening facing the belt 1, a developing roller or toner carrier 14, and a feed roller or feeding member 15 for feeding toner to the developing roller 14. The developing section 11 further includes an agitator or conveying member 17 for conveying toner present in the casing 13 toward the feed roller 15 and a doctor roller or metering member 16.

The developing roller 14 is partly exposed to the outside via the opening mentioned above and is rotated counterclockwise, as viewed in FIG. 2, at a preselected linear velocity. In this condition, the developing roller 14 conveys toner deposited thereon to a developing position where the developing roller 14 and belt 1 contact each other, causing the toner to develop a latent image formed on the belt 1. In the illustrative embodiment, the developing roller 14 is formed of metal. The feed roller 15 is pressed against the developing roller 14 by preselected pressure at a position above the axis of the developing roller 14 and is also rotated counterclockwise, as viewed in FIG. 2. The surface of the feed roller 15 is formed of foam polyurethane. The agitator 17 is rotated counterclockwise, as viewed in FIG. 2, for feeding toner toward part of the feed roller 15 between the feed roller 15 and the doctor roller 16. The agitator 17 may be formed of polypropylene or similar soft, elastic material so as to surely convey the toner in close contact with the inner wall of the casing 13.

The doctor roller 16 is positioned below the feed roller 15 and rotated clockwise, as viewed in FIG. 2, opposite in direction to the developing roller 14 at the position where the doctor roller 16 and developing roller 14 face each other. In this condition, the doctor roller 16 regulates a toner layer formed on the developing roller 14 to preselected thickness while electrifying the toner in contact therewith. The toner, charged on the surface of the developing roller 14, develops a latent image formed on the belt 1. In the illustrative embodiment, the surface of the doctor roller 16 is formed of urethane rubber coated with resin. A cleaning blade, not shown, is held in contact with the doctor roller 16 in order to clean part of the doctor roller 14 moved away from the position where the doctor roller 16 faces the developing roller 14.

In the illustrative embodiment, a spring or biasing means, not shown, constantly presses the doctor roller 16 against the developing roller 14 in order to absorb changes in the outside diameter of the developing roller 14 and that of the doctor roller 16 ascribable varying ambient conditions including humidity. Inlet seals, not shown, are positioned on the inner periphery of the casing 13 in such a manner as to contact the developing roller 14 at their edges, preventing the toner from leaking via gaps between the developing roller 14 and the casing 13.

The toner cartridge or developer storing section 12 includes agitators 27*a* and 27*b* rotatable counterclockwise, as viewed in FIG. 2, to replenish fresh toner or developer to the developing section 11. The agitators 27*a* and 27*b*, like the agitator 17, each may be formed of polypropylene or similar soft, elastic material so as to surely convey the fresh toner while being rotated in elastic contact with the inner periphery of the toner cartridge 12.

The fresh toner is replenished from the toner cartridge 12 to the developing section 11 via a toner or developer replenishing opening 20, which is formed in both of the toner cartridge 12 and casing 13. The toner replenishing openings 20 of the toner cartridge 12 and casing 13 align with each other when the toner cartridge 12 is mounted to the developing unit 5Bk. In the illustrative embodiment, the mean amount of toner to be replenished from the toner cartridge 12 to the developing section 11 is selected to be greater than the mean amount of toner to be transferred from the developing roller 14 to the belt 1 during continuous operation. This configuration, however, is apt to cause an excessive amount of toner to be replenished to the developing section 11 and bring about toner blow-off or toner blocking. Also shown in FIG. 2 are a check valve 23 for selectively closing the toner inlet 20 of the developing section 11 and a seal 24 for allowing the developing section 11 and toner cartridge 12 to closely contact each other.

Figure 3:
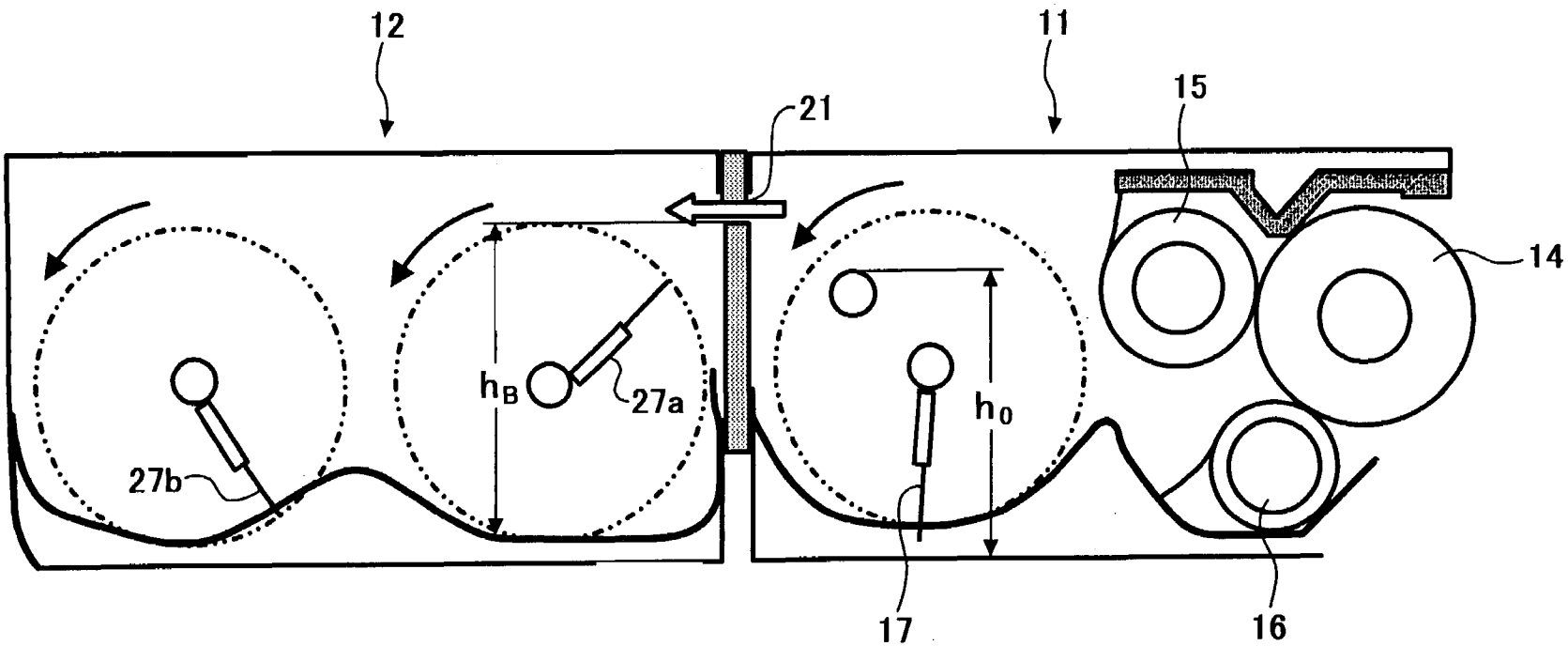
FIG. 3 is a section showing a toner or developer returning opening also included in the illustrative embodiment.

As shown in FIG. 3, a toner or developer discharging opening is formed in order to discharge the toner from the developing section 11 for thereby obviating the blow-off or similar undesirable occurrence. In the illustrative embodiment, the toner discharging opening is implemented as toner returning openings 21 (only one is visible) for returning the toner from the developing section 11 to the toner cartridge 12.

We conducted a series of experiments and found that the toner could not be smoothly returned from the developing section 11 to the toner cartridge 12 or that the toner was immediately returned from the former to the latter after replenishment, depending on the position of the toner returning openings 21. When the toner was not smoothly returned, torque necessary for driving the developing section 11 increased to an unusual level. Also, when the toner was immediately returned after replenishment, deteriorated toner could not be replaced with the fresh toner. The position of the toner replenishing openings 20 and that of the toner returning openings 21 are the key to the solution of the above problems.

Figure 4:
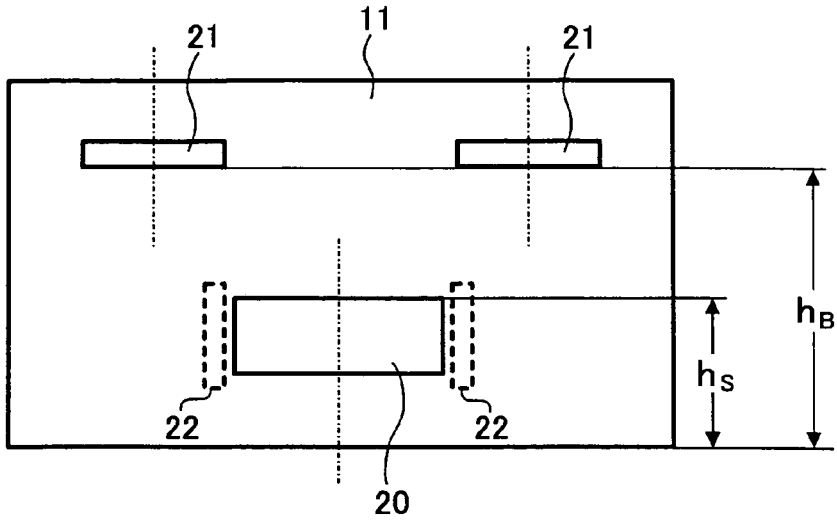
FIG. 4 is a side elevation showing a positional relation between the toner replenishing opening and the tone returning openings of the illustrative embodiment.

FIG. 4 shows a positional relation between the toner replenishing openings 20 and the toner returning openings 21 shown in FIGS. 2 and 3, respectively. As shown in FIGS. 1 through 4, the toner replenishing opening 20 is located at a position where the force of the agitator 27, which is disposed in the toner cartridge 12 for moving the toner toward the developing section 11, strongly acts. In the illustrative embodiment, the toner replenishing opening 20 is positioned at substantially the center in the axial direction of the developing roller 14 (i.e., the lengthwise direction) and extends over about one-third of the entire length of the roller 14. On the other hand, the toner returning openings 21 are located at a position where the force of the agitator 27 mentioned above acts little and at a higher level than the toner replenishing opening 20. More specifically, the toner returning openings 21 are shifted from each other in the lengthwise direction so as not to be directly vertically above the toner replenishing opening 20. While the toner returning openings 21 should ideally not overlap the toner replenishing opening 20 in the lengthwise direction, as shown in FIG. 4, the former may slightly overlap the latter so long as the expected function is achievable.

In the developing unit 5 described above, the force of the agitator 27 disposed in the toner cartridge 12 and rotated to move the toner is not directly imparted to the toner return openings 21. Therefore, part of the toner positioned above the toner returning openings 21 is surely returned to the toner cartridge 12 by the rotation of the agitator 17 disposed in the developing section 11. This is successful to protect the developing section 11 from the blow-off or the blocking of toner ascribable to the excessive replenishment of toner to the developing section 11.

Assume that the height of the toner returning openings 21 above the bottom of the developing unit 5 is $h_B$, that the height of the toner replenishing opening 20 above the bottom of the developing unit 5 is $h_S$, and that a height corresponding to a toner-end level Sin the developing section 11 is $h_O$. Then, there should preferably be satisfied a relation:

$$h_B > h_O > h_S$$

Further, assume the shortest distance between the circumference of the locus of rotation of the agitator 27 and the toner replenishing openings 20, the shortest distance between the circumference of locus of rotation of the agitator 17 disposed in the developing section 11 and the toner replenishing openings 20, the shortest distance between the circumference of the former and the toner returning openings 21, and the shortest distance between the circumference of the latter and the toner returning openings 21. Then, the circumference of the agitator 27 should preferably be closer to the toner replenishing opening 20 than the circumference of the agitator 17 while the latter should preferably be closer to the toner returning openings 21 than the former.

Moreover, it is preferable to form projections at opposite ends of the toner replenishing opening 20 of the toner cartridge 21 or to form projections 22, not shown, at opposite ends of each toner returning opening 21 of the developing section 11, so that each other's rotating forces are prevented from being imparted to the other via the opening 20 or the openings 21.

Figure 5:
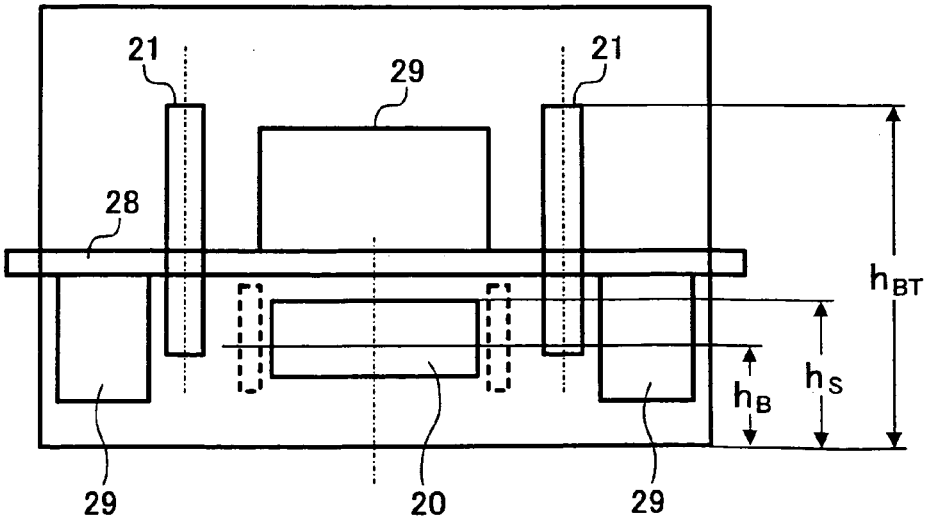
FIG. 5 shows a toner replenishing opening and toner returning openings representative of an alternative embodiment of the present invention.

An alternative embodiment of the present invention will be described with reference to FIG. 5 hereinafter. As shown, in the illustrative embodiment, the toner returning openings 21 each are elongate in the up-and-down direction while the toner replenishing opening 20 is absent around the top or the bottom of the toner return opening 21. In the illustrative embodiment, the agitator disposed in the toner cartridge 12 is replaced with a plurality of blades 29 mounted on a rotary shaft 28, but absent around the toner returning openings 21. More specifically, the blades 29 are separate from each other in the axial direction of the shaft 28 and shifted in position from each other in the circumferential direction of the shaft 28. For example, three blades 29 may be mounted on the shaft 28 at positions angularly shifted from each other by 120°.

In the developing device 5 described above, the force of the agitator 27 in rotation is not directly imparted to the toner returning openings 21, so that part of the toner positioned above the toner returning opening 21 of the developing section 11 is surely returned to the toner cartridge 12 by the agitator 17. This is also successful to protect the developing section 11 from the blow-off or the blocking of toner ascribable to the excessive replenishment of toner to the developing section 11.

In the illustrative embodiment, too, there should preferably hold a relation:

$$h_{BT} > h_O > h_S > h_B$$

where $h_{BT}$ denotes the distance or height between the top of each toner return opening 21 and the bottom of the developing unit 5.

Figure 6:
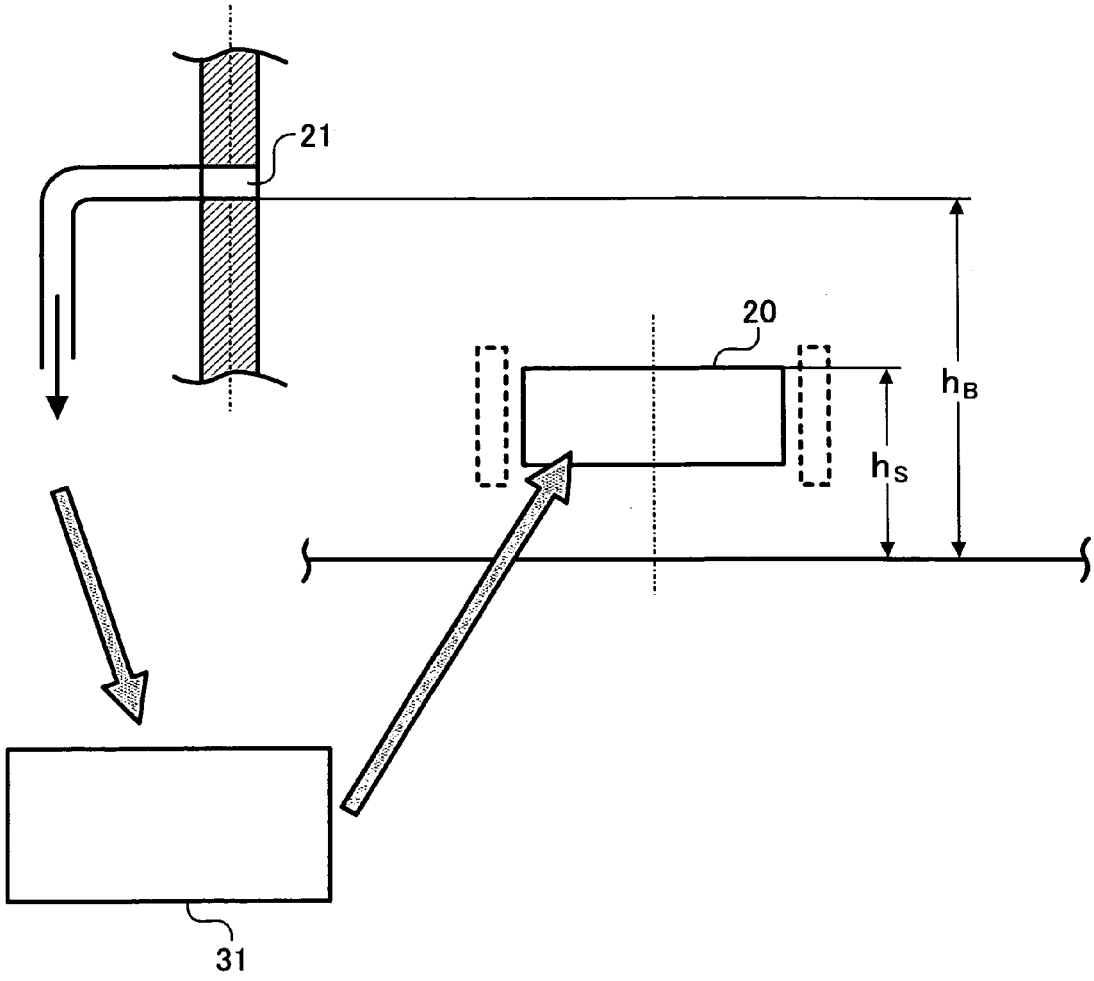
FIG. 6 shows a further alternative embodiment of the present invention.

FIG. 6 shows another alternative embodiment of the present invention. As shown, in the illustrative embodiment, the toner returning opening 21 is not formed in the wall of the developing section 11 that faces the toner cartridge 12. More specifically, assuming that the above wall of the developing section 11 is a front wall, then the toner returning opening 21 is formed in the side wall of the developing section 11. In this configuration, the toner present in the developing section 11 is not returned to the toner cartridge 12, but is delivered to a waste toner container 31 via the toner returning opening 21.

In the illustrative embodiment, the toner, once used in the developing section 11 and therefore deteriorated, is discarded and replaced with fresh toner little by little. It is therefore possible to insure stable image quality over a long period of time by controlling the deterioration of the toner in the developing section 11. It is to be noted that the waste toner container 31 may be implemented as a single container removably mounted to the developing section 11 or as a partitioned spaced formed in the toner cartridge 12 and therefore removable integrally with the toner cartridge 12, as desired.

In the illustrative embodiments shown and described, the mean amount of toner to be replenished from the toner cartridge 12 to the developing section 11 is selected to be greater than the mean amount of toner to be transferred from the developing roller 14 to the belt 1 during continuous operation, as stated earlier. More specifically, assume that fresh toner is replenished in a greater amount than toner deposited on and therefore consumed by the photoconductive element when a latent image with a small image area ratio is repeatedly developed. For example, assume that even when the area ratio of an image is 1%, toner corresponding in the amount of consumption to 3% is replenished to the developing section 11 while excess toner is discharged from the developing section 11 via the toner discharging openings 21. Then, toner in the developing section 11 can be replaced with fresh toner little by little without increasing loads on the photoconductive drum or the cleaner. To further reduce wasteful toner replenishment, the amount of replenishment may be sensed and controlled or the amount of toner to be deposited on the photoconductive element may be calculated and subject to feedback control.

In any one of the illustrative embodiments, an arrangement may be made such that the toner or developer discharged via the toner returning openings 21 is classified into reusable toner and toner to be discarded by toner or developer classifying means. That is, toner deteriorated in the developing section 11 and then discharged does not have to be entirely discarded, but may be classified by a conventional filter, gravity, electrostatic force or the like so as to return reusable part of the toner, thereby reducing the amount of waste toner. More specifically, in the illustrative embodiment shown in FIG. 6, the waste toner container or waste developer containing section 31 may be replaced with toner or developer classifying means configured to discard only the toner heavily damaged while returning reusable toner to the toner cartridge 12. In this case, the classifying means may be configured to classify toner collected by the belt cleaner 7 also in order to minimize the amount of waste toner and effectively use limited resources and, moreover, to prevent image quality from being lowered.

The developing device of any one of the illustrative embodiments may be used as a cleanerless system in which it plays the role of the belt cleaner 7 at the same time. In this configuration, the toner present in the developing section 11 is replaced with fresh toner little by little, protecting images from degradation ascribable to the collected toner.

In accordance with the present invention, the developing device uses toner grains on which additives are deposited in an amount of one-tenth of the mean volumetric grain size of the toner inclusive or below. Therefore, even when the additives are separated from or buried in the cores of the toner grains, replenished toner can sufficiently make up for the loss of additives. In addition, the additives separated from the cores move upward in the developing section 11 and then discharged, so that an adequate amount of additives can be stably maintained in the developing section 11 to thereby extend the life of the toner.

Figure 7:
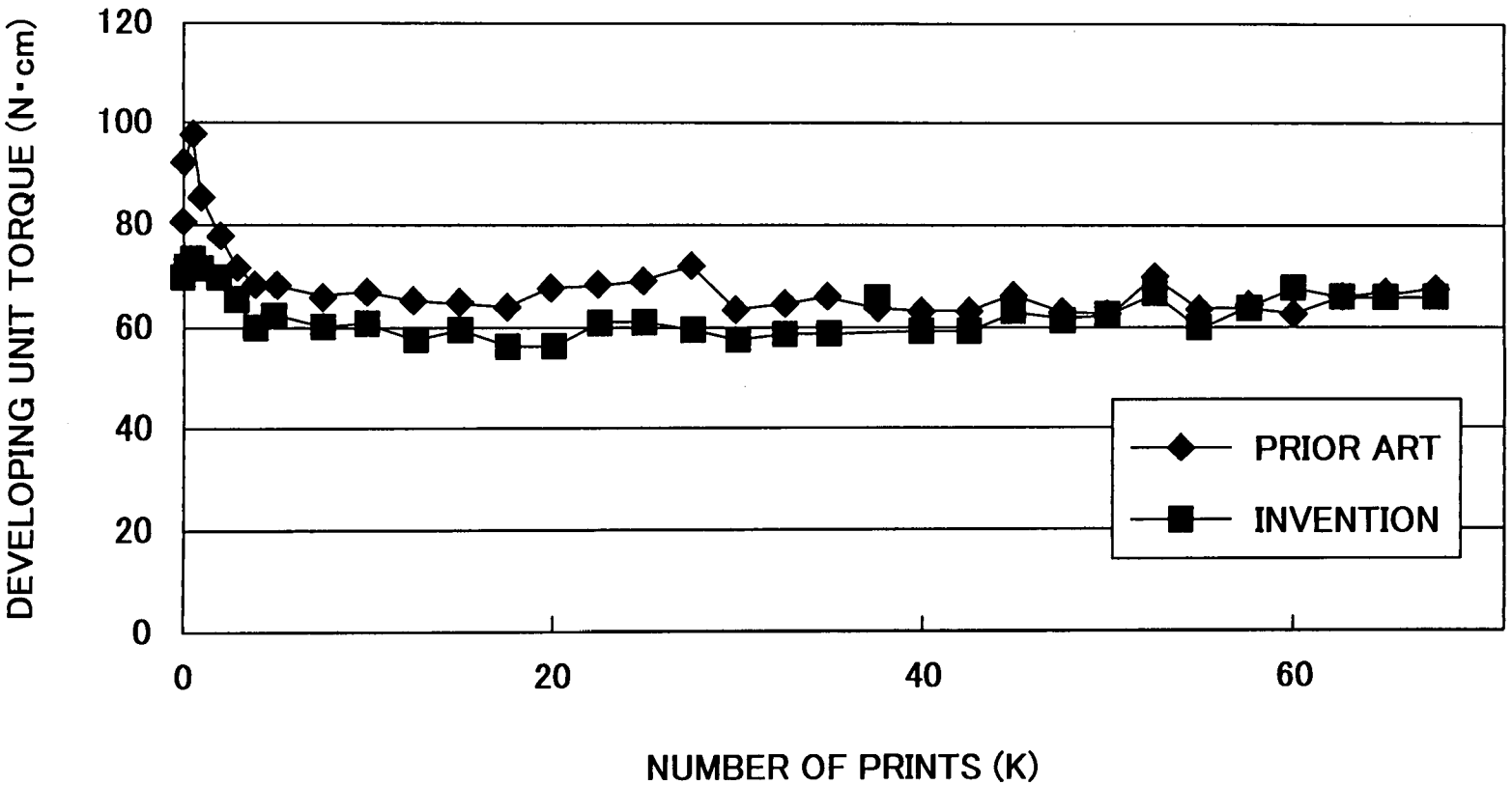
FIG. 7 is a graph comparing the developing device of the present invention and a conventional developing device as to the variation of torque.

Toner grains to be replenished from the toner cartridge 12 to the developing section 11 may be higher in the ratio of additives deposited thereon than toner grains to be set in the developing section 11 for the first time. This prevents the additives of the toner grains present in the developing section 11 from being buried in the cores and maintains the fluidity of the toner grains relatively high, thereby insuring the desirable electrification of the toner while maintaining friction between the toner and members contacting it relatively low. Consequently, it is possible to reduce torque required of the developing device and insure high image quality at the same time. FIG. 7 compares the developing unit of the present invention and a conventional developing unit as to the variation of torque. As shown, the present invention successfully controls the rise of torque at the beginning of use.

The developing device of the present invention, effecting contact development with a one-component type developer, should preferably satisfy a relation:

$$0<|V_D|-|V_B|<|V_D-V_L|<400V$$

where $V_D$ denotes the potential of the image carrier in the dark, $V_L$ denotes a potential after exposure, and $V_B$ denotes a bias voltage for development. This relation allows development to be effected with a potential difference of 400 V or below for thereby reducing electrostatic hazards to the photoconductive element and therefore extending the life of the photoconductive element.

Figure 8:
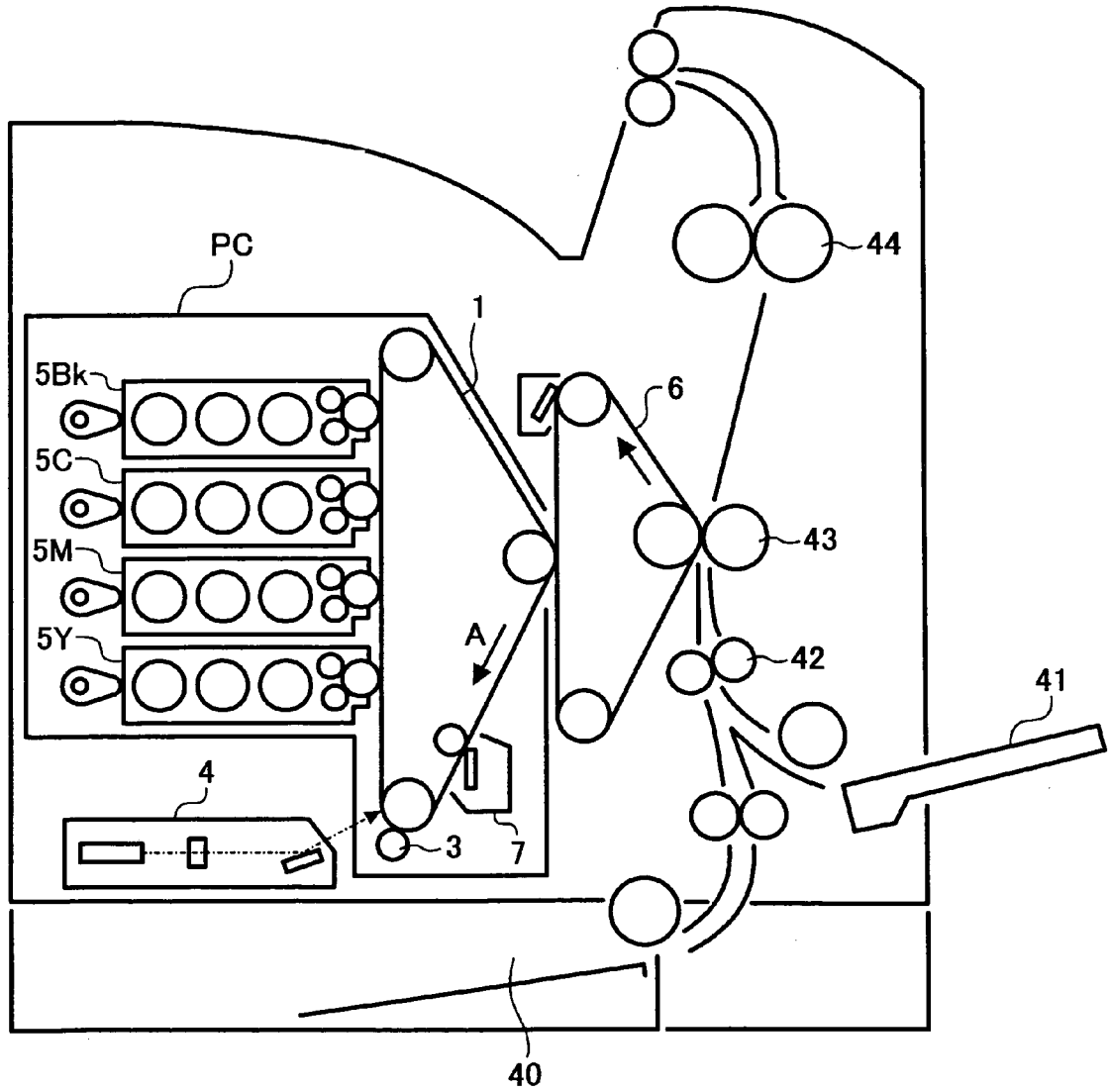
FIG. 8 is a view showing a specific configuration of a process cartridge constructed in accordance with the present invention.

Further, the developing device of the present invention is capable of extending the life of toner stored in the developing section 11. Therefore, as shown in FIG. 8 specifically, if at least the image carrier and developing unit are constructed into a single process cartridge PC removable from the apparatus body, then the durability of the toner is further extended to increase the interval between consecutive times of maintenance while reducing the frequency of replacement of the process cartridge PC, thereby enhancing efficient maintenance and operation. The process cartridge may further include charging means, developing means, cleaning means and so forth, if desired. This is also successful to achieve the above advantages.

In any one of the illustrative embodiments, a plurality of openings are formed in the lengthwise direction of the developing unit. This prevents the amount of developer in the developing unit from being irregular in the lengthwise direction and therefore obviates irregular image density. Moreover, it is possible to prevent the developer from accumulating at opposite lengthwise ends of the developing section, further enhancing the above advantages.

Specifications of the developing device in accordance with the present invention are as follows. The developing roller was provided with a diameter of 26 mm and a surface formed of polyester-melamine resin and carbon black. The surface layer of the developing roller had electric resistance of 4 LogΩ and surface roughness of 2.6 μm Rz.

The feed roller was provided with an outside diameter of 16 mm, made of foam polyurethane and carbon black, ion-conductive material or similar conductive material, and provided with electric resistance of 6 LogΩ. The feed roller bit into the developing roller by 0.5 mm.

The regulating roller or metering member was provided with an outside diameter of 14 mm, a surface made of fluoric resin and carbon black, ion conductive material or similar conductive material, electric resistance of 4 LogΩ to 7 LogΩ, hardness of 75° in JIS (Japanese Industrial Standard) K6253 scale, and surface roughness of 2.6 μm Rz. With this configuration, the regulating roller was rotated either intermittently or constantly, as the case may be.

As for black toner, 100 parts by weight of low molecular weight, polyester resin, 6 parts by weight of carbon black and one part by weight of high molecular weight, charge control agent were kneaded by a conventional screw kneader, rolled by cooling, roughly pulverized, finely pulverized by a jet mill and finally classified by an air-stream type classifier to obtain toner grains having a volume-mean grain size of 6.7 μm and a number-mean grain size of 6.1 μm. Magenta toner, cyan toner and yellow toner each were produced in the same manner as the black toner except for the color of a pigment.

Subsequently, 0.3 part by weight of silica was added to 100 parts of weight of each toner and then mixed together by a Henschel mixture for 1 minute. Thereafter, 0.3 part by weight of titania was added to the toner and then mixed together for 1 minute, and then 1.0 part of weight of silica was further added and mixed for 1 minutes. The mean amount of charge measured on the surface of the developing roller was 30 μC/g.

The photoconductive element was measured to have a mean potential (VL) of −50 V in a black, solid portion and a mean potential (Vd) of −500 V in a background portion.

In summary, it will be seen that the present invention provides a developing device using a dry one-component type developer and capable of reducing damage to toner to thereby extend the life of the developing device and toner. Further, the developing device of the present invention obviates the unusual rise of dynamic torque ascribable to erroneous toner-end sensing or excess toner present in a toner storing section, and implements toner recycling while protecting toner from deterioration. It is therefore possible to reduce required torque and realize high-quality development at the same time.

Various modifications will become possible for those skilled in the art after receiving the teachings of the present disclosure without departing from the scope thereof.

What is claimed is:

1. A developing device for developing a latent image formed on an image carrier, said developing device comprising:

a developing section comprising a developer carrier for conveying a one-component type developer deposited thereon, a feeding member for feeding said developer to said developer carrier, and a conveying member for conveying said developer toward said feeding member while agitating said developer;

a developer storing section for storing the developer and replenishing said developer to said developing section in a direction including at least a horizontal direction component;

said developing section and said developer storing section being formed with a plurality of openings whose centers are shifted in a lengthwise direction of the developer carrier such that replenishment of the developer from said developer storing section to said developing section and return of said developer from said developing section to said developer storing section are executed via said plurality of openings.

2. A developing device for developing a latent image formed on an image carrier, said developing device comprising:

a developing section comprising a developer carrier for conveying a one-component type developer deposited thereon, a feeding member for feeding said developer to said developer carrier, and a conveying member for conveying said developer toward said feeding member while agitating said developer;

a developer storing section for storing the developer and replenishing said developer to said developing section in a direction including at least a horizontal direction component;

said developing section and said developer storing section being formed with a plurality of openings in a lengthwise direction of the developer carrier such that replenishment of the developer from said developer storing section to said developing section and return of said developer from said developing section to said developer storing section are executed via said plurality of openings, wherein among said plurality of openings, an opening positioned at a center in the lengthwise direction is configured to cause the developer to be replenished from said developer storing section to said developing section in a greater amount than the developer to be returned from said developing section to said developer storing section, and an opening positioned at an end portion in the lengthwise direction is configured to cause the developer to be returned from said developing section to said developer storing section in a greater amount than the developer to be replenished from said developer storing section to said developing section.

3. A developing device for developing a latent image formed on an image carrier, said developing device comprising:

a developing section comprising a developer carrier for conveying a one-component type developer deposited thereon, a feeding member for feeding said developer to said developer carrier, and a conveying member for conveying said developer toward said feeding member while agitating said developer;

a developer storing section for storing the developer and replenishing said developer to said developing section in a direction including at least a horizontal direction component;

said developing section and said developer storing section being formed with a plurality of openings in a lengthwise direction of the developer carrier such that replenishment of the developer from said developer storing section to said developing section and return of said developer from said developing section to said developer storing section are executed via said plurality of openings, wherein said plurality of openings comprise a developer replenishing opening for replenishing the developer stored in said developer storing section to said developing section and a developer discharging opening for returning the developer present in said developing section to said developer storing section, a lower end of said developer discharging opening is positioned at a lower level than a lower end of said developer replenishing opening, and a center of said developer replenishing opening and a center of said developer discharging opening are shifted in position from each other in the longitudinal direction of said developer carrier.

4. The developing device as claimed in claim 3, further comprising developer-end sensing means for sensing a developer-end condition in said developing section.

5. The developing device as claimed in claim 4, wherein the lower end of said developer discharging opening is positioned at a higher level than a developer-end sensing level assigned to said developer end sensing means.

6. The developing device as claimed in claim 3, wherein an upper end of said developer discharging opening is positioned at a higher level than an upper end of said developer replenishing opening.

7. The developing device as claimed in claim 3, wherein the developer discharged via said developer discharging opening is returned to said developer storing section.

8. The device as claimed in claim 7, wherein the developer discharged from said developer discharging opening is classified into a developer to be reused and a developer to be discarded.

9. The device as claimed in claim 3, wherein the developer discharged from said developer discharging opening is collected in a waste developer containing section.

10. The device as claimed in claim 3, wherein said developer storing section is removably mounted to said developing section, and said developer replenishing opening comprises openings formed in walls of said developing section and said developer storing section that face each other, said openings being communicated to each other when said developer storing section is mounted to said developing section.

11. The developing device as claimed in claim 3, wherein a mean amount of the developer replenished from said developer storing section to said developing section when said image carrier is continuously operated is greater than a mean amount of the developer to be transferred from said developer carrier to said image carrier.

12. The developing device as claimed in claim 3, wherein additives are deposited on outer surfaces of the developer in an amount of one-tenth of a volume-mean grain size of said developer or below.

13. The developing device as claimed in claim 12, wherein a ratio of the additives deposited on the developer to be replenished from said developer replenishing section is higher than a ratio of the additives deposited on a developer set in said developing section for the first time.

14. An image forming apparatus comprising:

an image carrier;

latent image forming means for exposing said image carrier to thereby form a latent image on said image carrier;

a developing device for developing the latent image formed on said image carrier with a one-component type developer; and a cleaner for removing the developer left on said image carrier;

said developing device comprising:

a developing section comprising a developer carrier for conveying the developer deposited thereon, a feeding member for feeding said developer to said developer carrier, and a conveying member for conveying said developer toward said feeding member while agitating said developer;

a developer storing section for storing the developer and replenishing said developer to said developing section in a direction including at least a horizontal direction component;

said developing section and said developer storing section being formed with a plurality of openings whose centers are shifted in a lengthwise direction of the developer carrier such that replenishment of the developer from said developer storing section to said developing section and return of said developer from said developing section to said developer storing section are executed via said plurality of openings.

15. The apparatus as claimed in claim 14, wherein the developer collected by said cleaner is returned to said developer storing section.

16. An image forming apparatus comprising:

an image carrier;

latent image forming means for exposing said image carrier to thereby form a latent image on said image carrier;

a developing device for developing the latent image formed on said image carrier with a one-component type developer; and a cleaner for removing the developer left on said image carrier;

said developing device comprising:

a developing section comprising a developer carrier for conveying the developer deposited thereon, a feeding member for feeding said developer to said developer carrier, and a conveying member for conveying said developer toward said feeding member while agitating said developer;

a developer storing section for storing the developer and replenishing said developer to said developing section in a direction including at least a horizontal direction component;

said developing section and said developer storing section being formed with a plurality of openings in a lengthwise direction of the developer carrier such that replenishment of the developer from said developer storing section to said developing section and return of said developer from said developing section to said developer storing section are executed via said plurality of openings, wherein there holds a relation:

$$0<|VD|-|VB|<|VD-VL|<400\ V$$

where VD denotes a potential of said image carrier in the dark, VL denotes a potential of said image carrier after exposure, and VB denotes a bias voltage for development.

17. A process cartridge comprising:

an image carrier; and a developing device;

said developing device comprising:

developing section comprising a developer carrier for conveying a one-component type developer deposited thereon, a feeding member for feeding said developer to said developer carrier, and a conveying member for conveying said developer toward said feeding member while agitating said developer;

a developer storing section for storing the developer and replenishing said developer to said developing section in a direction including at least a horizontal direction component;

said developing section and said developer storing section being formed with a plurality of openings whose centers are shifted in a lengthwise direction of the developer carrier such that replenishment of the developer from said developer storing section to said developing section and return of said developer from said developing section to said developer storing section are executed via said plurality of openings.

* * * * *